US009716309B1

(12) United States Patent
ElSallal

(10) Patent No.: US 9,716,309 B1
(45) Date of Patent: Jul. 25, 2017

(54) MULTIFUNCTIONAL, MULTI-BEAM CIRCULAR BAVA ARRAY

(75) Inventor: M. Wajih ElSallal, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 671 days.

(21) Appl. No.: 13/494,517

(22) Filed: Jun. 12, 2012

(51) Int. Cl.
*H01Q 1/38* (2006.01)
*H01Q 5/00* (2015.01)

(52) U.S. Cl.
CPC ..... *H01Q 1/38* (2013.01); *H01Q 5/00* (2013.01)

(58) Field of Classification Search
CPC ..... H01Q 1/38; H01Q 13/10; H01Q 13/106; H01Q 13/085; H01Q 13/206; H01Q 21/0012; H01Q 21/0056
USPC ..... 343/700 MS, 767, 770, 795
See application file for complete search history.

(56) References Cited

U.S. PATENT DOCUMENTS 4,001,834 A * 1/1977 Smith ..... 343/754
4,051,477 A * 9/1977 Murphy ..... H01Q 9/0414 343/700 MS
4,782,346 A * 11/1988 Sharma ..... 343/795
5,872,546 A * 2/1999 Ihara ..... H01Q 9/28 343/795
7,486,247 B2 * 2/2009 Ridgway et al. ..... 343/767
8,182,103 B1 * 5/2012 Brown et al. ..... 359/849
8,466,845 B2 * 6/2013 Elsallal ..... H01Q 13/08 343/770
8,466,846 B1 * 6/2013 Elsallal ..... H01Q 1/38 343/700 MS
8,504,135 B2 * 8/2013 Bourqui ..... H01Q 1/3233 343/785
8,648,759 B2 * 2/2014 Wang et al. ..... 343/770
8,736,504 B1 * 5/2014 West ..... H01Q 13/085 343/767
8,743,015 B1 * 6/2014 West ..... H01Q 1/12 343/853
8,902,114 B1 * 12/2014 West ..... H01Q 25/00 343/722
9,000,996 B2 * 4/2015 Holland ..... H01Q 9/28 343/700 MS
9,024,834 B1 * 5/2015 ElSallal ..... H01Q 1/38 343/767

* cited by examiner

*Primary Examiner* — Jean B Jeanglaude
(74) *Attorney, Agent, or Firm* — Angel N. Gerdzhikov; Donna P. Suchy; Daniel M. Barbieri

(57) ABSTRACT

A radar, communication, discovery and networking system is disclosed. The system utilizes a parallel plate waveguide simulator in combination with a circular array of Balanced Antipodal Vivaldi Antenna elements to support very broad bandwidth operations utilizing a low-profile aperture. It is contemplated that such configurations may be applied to linear arrays (i.e., with no curvature) as well. In addition, the antenna arrays may form multiple rows to resemble a planar antenna. The antenna system in accordance with the present disclosure may be installed on a size-constrained platform and utilized as a common shared asset aperture, providing multifunctional, multi-beam support to facilitate multiband communications.

20 Claims, 4 Drawing Sheets

MULTIFUNCTIONAL, MULTI-BEAM CIRCULAR BAVA ARRAY

TECHNICAL FIELD

The present disclosure relates generally to radar systems and more particularly to a circular Balanced Antipodal Vivaldi Antenna (BAVA) array.

BACKGROUND

Modern radar systems may utilize various types of antennas to provide a variety of functions. Such functions may include, for example, intelligence-gathering (e.g., signals intelligence, or SIGINT), direction finding (DF), electronic countermeasure (ECM) or self-protection (ESP), electronic support (ES), electronic attack (EA) and the like. Providing such multi-function capability from a single aperture to modern platforms is becoming an essential requirement. However, due to the limited space available on size-constrained platforms such aerial vehicles or the like, placing the various types of antennas is becoming a challenge.

Therein lies the need to provide a single compact multi-functional, multi-beam aperture that is capable of facilitating multiband communication.

SUMMARY

The present disclosure is directed to a radar system. The radar system may include a disc-shaped conductive substrate and a ring-shaped conductive substrate being positioned generally parallel with respect to the disc-shaped conductive substrate. The ring-shaped conductive substrate may have an outer diameter generally coincides with an outer diameter of the disc-shaped conductive substrate. The radar system may also include a plurality of Balanced Antipodal Vivaldi Antenna (BAVA) elements disposed between the disc-shaped conductive substrate and the ring-shaped conductive substrate. The plurality of BAVA elements may form a circular antenna array along edges of the disc-shaped conductive substrate and the ring-shaped conductive substrate, and the disc-shaped conductive substrate and the ring-shaped conductive substrate jointly form a parallel plate waveguide for the circular antenna array.

A further embodiment of the present disclosure is directed to a radar system. The radar system may include a first conductive substrate and a second conductive substrate being positioned generally parallel with respect to the first conductive substrate. The second conductive substrate may define an outer perimeter that generally coincides with an outer perimeter of the first conductive substrate. The second conductive substrate may further define an opening at a center of the second conductive substrate. The radar system may further include a plurality of BAVA elements disposed between the first conductive substrate and the second conductive substrate. The plurality of BAVA elements may form a continuous antenna array along edges of the first conductive substrate and the second conductive substrate, and the first conductive substrate and the second conductive substrate jointly form a parallel plate waveguide for the continuous antenna array.

An additional embodiment of the present disclosure is directed to a radar system. The radar system may include a plurality of unit cells. Each unit cell may include a first conductive substrate, a second conductive substrate being positioned generally parallel with respect to the first conductive substrate, and a BAVA element disposed between the first conductive substrate and the second conductive substrate. The plurality of unit cells form a continuous antenna array, and the first conductive substrate and the second conductive substrate of each of the plurality of unit cells jointly form a parallel plate waveguide for the continuous antenna array.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which:

FIGS. 6A and 6B are illustrations depicting the radar system in accordance with the present disclosure utilized on a size-constrained platform such an aerial vehicle or the like.

DETAILED DESCRIPTION

Reference will now be made in detail to exemplary embodiments of the disclosure, examples of which are illustrated in the accompanying drawings.

Since the early 1960's, there has been an engineering knowledge that the performance of wide bandwidth phased arrays is limited at the low frequency end by the size of the array. For example, a planar 3:1 bandwidth of single polarized phased array needs an electrical size that is at least two-wavelength long at the low-frequency to achieve the full bandwidth for a center element. This size requirement of planar arrays increases, for a dual polarized version and/or for wider bandwidths. This has been attributed to truncation effects and mutual coupling. This fundamental limitation poses a significant challenge in designing linear or circular arrays that have small footprint and operate over wide bandwidth.

Figure 1B:
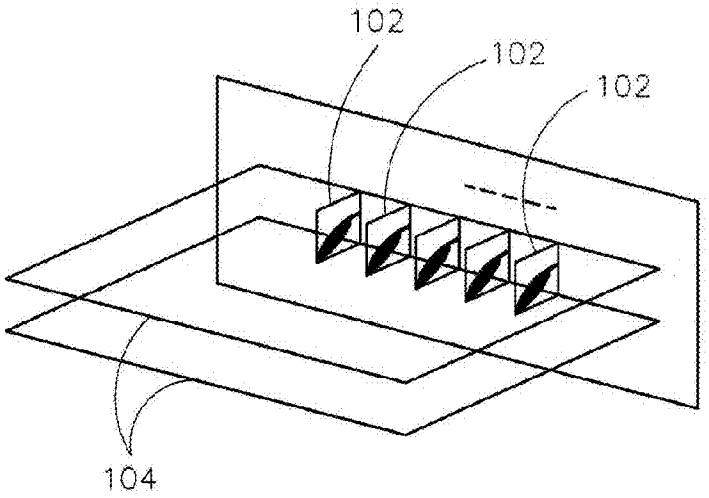
FIGS. 1A and 1B are illustrations of the parallel plate waveguide simulator concept.
Figure 1A:
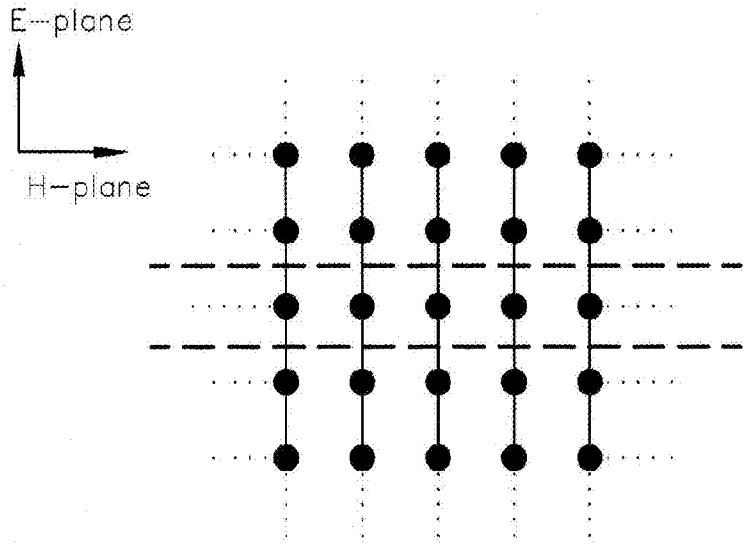

Recently, waveguide simulators have been used to emulate the infinite array environment by the means of electromagnetic (EM) image theory. The common practice for narrowband arrays was to enclose a single or a few elements in a rectangular or triangular waveguide, and use the results as a means to verify infinite array numerical simulations. Consider an infinite array of vertically polarized antennas depicted in FIG. 1A. The elements possess mirror symmetry in the horizontal planes. Assuming that the main beam scans in the H-plane only and the total electric field is perpendicular to these planes. Therefore, one row of the array may be placed between perfectly electrical conductor (PEC) planes that coincide with these planes of symmetry where the tangential E-field vanishes. Truncating the rows to a finite number of elements 102 simulates a finite-by-infinite array inside a parallel plate-waveguide 104, as shown in FIG. 1B. It is noted that the actual BAVA elements have been reduced to illustrations depicting only dielectric substrate and outer conductors for simplicity.

Further research extended this approach to study finite-by-infinite array environments using a parallel plate waveguide (PPWG) simulator (M. W. Elsallal, "Doubly-mirrored balanced antipodal Vivaldi antenna (DmBAVA) for high performance arrays of electrically short, modular elements," Ph.D. Thesis, Department of Electrical and Computer Engineering, University of Massachusetts, Amherst, 2007). This arrangement provides the full infinite array mutual coupling environment in the E-plane (XZ-plane) of the array, while the finite array mutual coupling is included in the H-plane (YZ-plane). Based on this arrangement, instead of building a full finite array as the 16×8 array in the example above, a single row of 8 elements in the PPWG is adequate to emulate of the performance of the a full-size array.

The present disclosure is directed to a radar, communication, discovery and networking system that utilizes a parallel plate waveguide simulator in combination with a circular array of Balanced Antipodal Vivaldi Antenna elements to support very broad bandwidth operations utilizing a low-profile aperture. It is contemplated that such configurations may be applied to linear arrays (i.e., with no curvature) as well. In addition, the antenna arrays may form multiple rows to resemble a planar antenna. The antenna system in accordance with the present disclosure may be installed on a size-constrained platform and utilized as a common shared asset aperture, providing multifunctional, multi-beam support to facilitate multiband communications.

Figure 2:
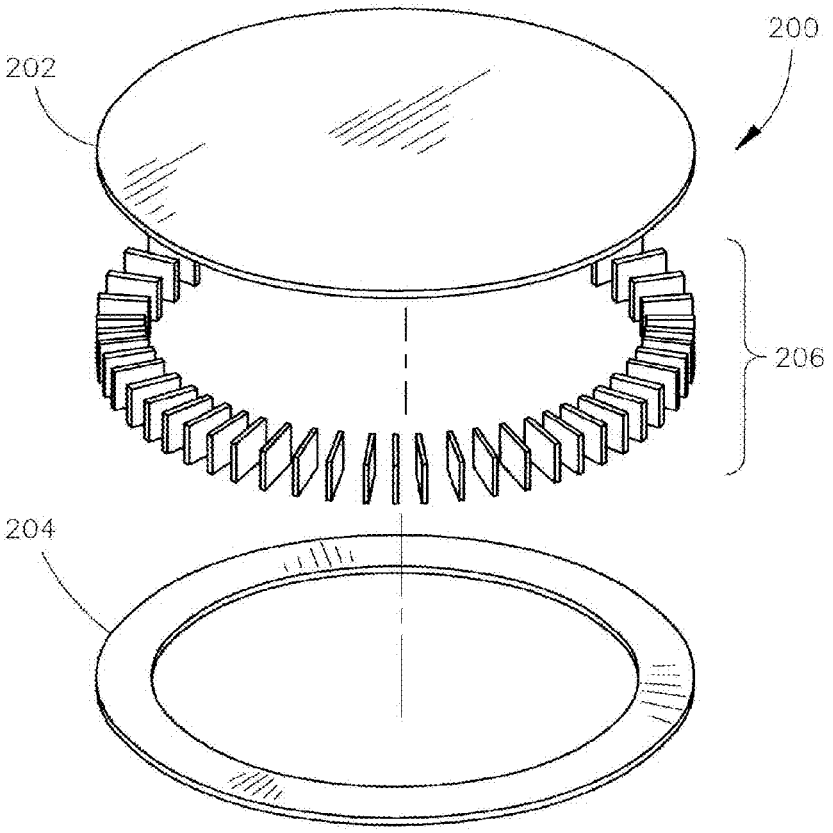
FIG. 2 is an exploded view of a radar system in accordance with the present disclosure.
Figure 3:
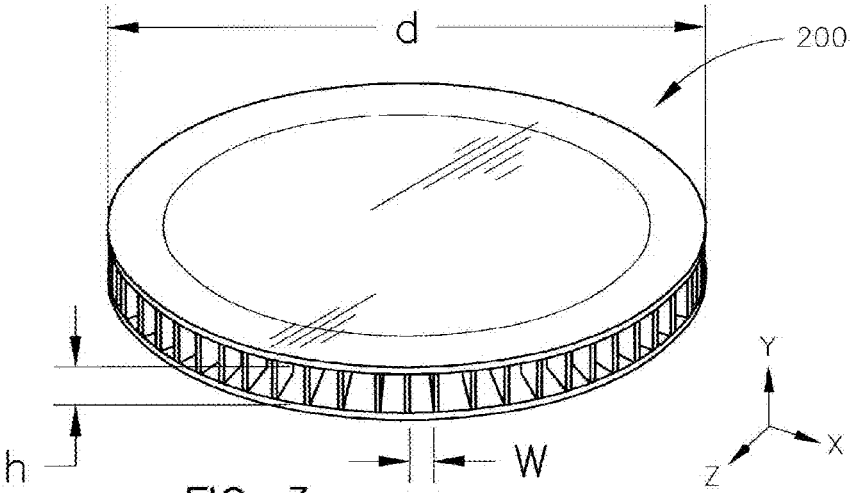
FIG. 3 is an isometric view of the radar system of FIG. 2.

Referring to FIGS. 2 and 3, illustrations depicting a radar system 200 in accordance with the present disclosure are shown. In one embodiment, the radar system 200 includes a disc-shaped conductive substrate 202 and a ring-shaped conductive substrate 204 positioned generally parallel with respect to each other. In addition, the outer diameter of the ring-shaped conductive substrate 204 coincides with the outer diameter of the disc-shaped conductive substrate 202.

The radar system 200 also includes a plurality of Balanced Antipodal Vivaldi Antenna elements 206 disposed between the disc-shaped conductive substrate 202 and the ring-shaped conductive substrate 204. Balanced Antipodal Vivaldi Antenna (BAVA) was first introduced by Langely, Hall and Newman (J. D. Langely et al, "Balanced Antipodal Vivaldi Antenna for Wide Bandwidth Phased Arrays," IEEE Proceeding of Microwave and Antenna Propagations, Vol. 143, No. 2, April 1996, pp. 97-102). A BAVA element uses an exponential flare of a three conductor slotline to slowly rotate the opposing electric field vectors of the triplate (stripline) mode into substantially parallel vectors for which the cross-polarized portions cancel in the boresight direction, and the co-polarized E-field portion propagates into the free-space.

In accordance with the present disclosure, the plurality of BAVA elements 206 are arranged to form a circular antenna array along the edges of the conductive substrates 202 and 204. The conductive substrates 202 and 204 jointly form a parallel plate waveguide for the circular antenna array. This approach leverages the unique properties of the electromagnetic image theory to employ mutual coupling of BAVA elements in an array environment, enabling wideband operation and size reduction of the radiating elements (i.e., low physical profile).

More specifically, two array parameters may be configured for providing multiband coverage ranging from ultra high frequency (UHF) to C-band. For instance, the E-plane spacing, denoted as h in FIG. 2, sets the parallel plate and the BAVA aperture heights. The H-plane spacing, denoted as w in FIG. 2, determines the frequencies at which grating lobes enter real space and also control mutual coupling between neighboring elements. In one embodiment, the E-plane spacing, h, may be configured to be approximately 1 inch, which equals $0.07\times\lambda$ at 830 MHz, the lowest operating frequency to be supported by the radar system 200. The H-plane spacing, w, may be configured to be approximately 1.2 inches, which equals to $0.5\times\lambda$ at 5 GHz, the highest operating frequency to be supported by the radar system 200. Testing results have confirmed that the array configuration as describe above allows the aperture to still radiate in spite the electrical height being $0.07\times\lambda$ at 830 MHz.

It is contemplated that the specific values of the array parameters described above are exemplary. These parameters may vary based on the operating frequencies supported by the antenna system. Furthermore, additional parameters such as the outer diameters d of the conductive substrates 202 and 204 may also be defined. In one embodiment, the outer diameters d of the conductive substrates 202 and 204 may be configured to be approximately 2 feet long, having approximately 1 inch tall BAVA elements evenly disposed (approximately 1.2 inches apart from each other) along the edges of the conductive substrates 202 and 204.

Figure 4:
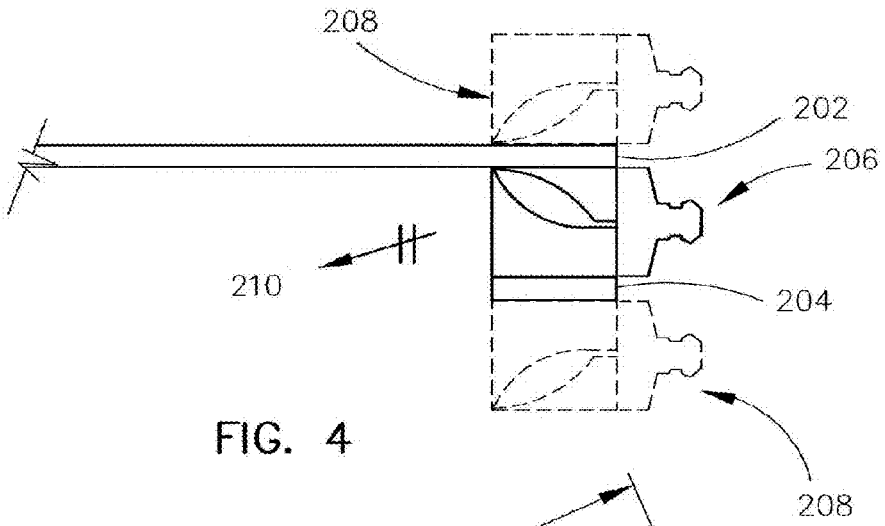
FIG. 4 is a partial cross-sectional view of the radar system of FIG. 3.

FIG. 4 is a partial cross-sectional view of the radar system 200 in accordance with the present disclosure. It is noted that the actual BAVA element 206 has been reduced to an illustration depicting only dielectric substrate and outer conductors for simplicity. The parallel plate waveguide formed by the conductive substrates 202 and 204 is illustrated in this figure. For example, the conductive substrates 202 and 204 may create imaged BAVA elements 208 that do not exist physically to emulate an infinite array environment. Also illustrate in this figure is that the ring-shaped conductive substrate 204 may terminate at the aperture of the BAVA element 206, allowing the BAVA element 206 to radiate freely towards the free space indicated as 210 in FIG. 4. Typically, ultra-wide band (UWB) is possible from an electrically large two dimensional aperture. Utilizing the parallel plate waveguide in accordance with the present disclosure, UWB may be achieved using a single row/array of BAVA elements 208.

While the exemplary embodiment above describes the conductive substrate 202 as a disc-shaped conductive substrate, it is contemplated that the conductive substrate 202 may also be configured as a ring-shaped conductive substrate in an alternative embodiment. In such a configuration, it is further contemplated that the inner diameter of the conductive substrate 202 may or may not coincide with the inner diameter of the conductive substrate 204. Furthermore, it is contemplated that a plurality of unit cells may be utilized to form a radar system having a circular BAVA array in accordance with the present disclosure.

Figure 5A:
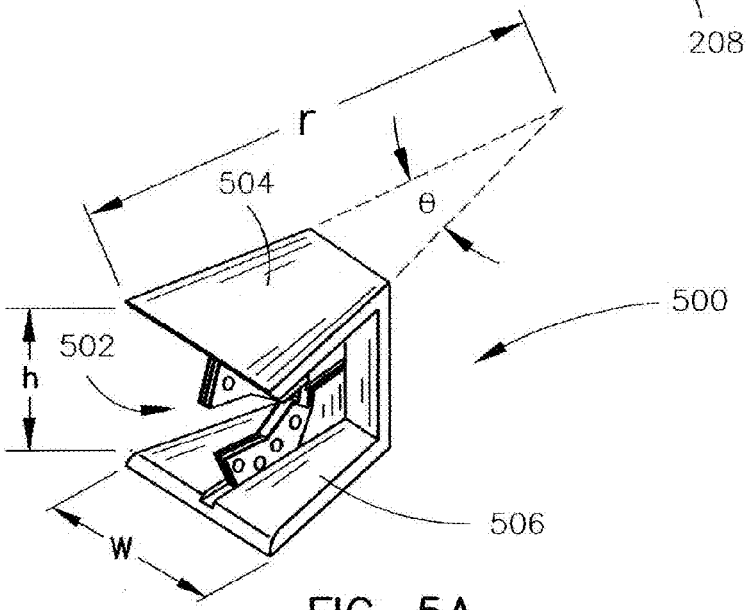
FIG. 5A is an isometric view of a BAVA unit cell in accordance with the present disclosure.
Figure 5B:
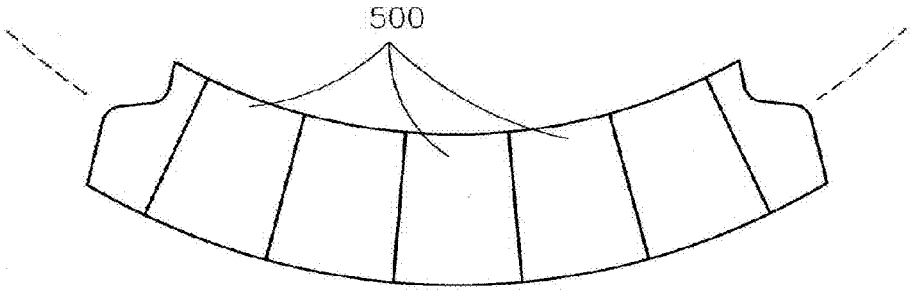
FIG. 5B is an illustration depicting a radar system formed utilizing a plurality of BAVA unit cells of FIG. 5A.

FIG. 5 is an isometric view of an exemplary unit cell 500 in accordance with the present disclosure. The unit cell 500 may include a BAVA element 502 disposed between a first conductive substrate 504 and a second conductive substrate 506 parallel to the first conductive substrate 504. The distance between the conductive substrates 504 and 506 defines the E-plane spacing, h, as described above. Furthermore, the width of the unit cell 500 defines the H-plane spacing, w, as described above. Additional parameters such as the sector opening angle, denoted as θ in FIG. 5, and the circular array radius, denoted as r in FIG. 5, may also be specified. In this manner, a plurality of unit cells 500 may be arranged to form a circular array that functions as described above.

It is contemplated that the first conductive substrate 504 and/or the second conductive substrate 506 may be extended beyond the aperture length (i.e., extend towards the center of the circular array) without departing from the spirit and scope of the present disclosure. Furthermore, the specific dimension of the unit cell 500 may vary and may be determined based on the specific configuration of the conformal/circular array. Certain unit cells 500 in accordance with the present disclosure may be utilized to form linear arrays without departing from the spirit and scope of the present disclosure.

It is also contemplated that the BAVA array in accordance with the present disclosure is not limited to a circular configuration. Various other continuous shapes such as ellipses, ovals or the like may be formed and may function similarly as previously described. It is also contemplated that the interior volume defined by the BAVA array may be utilized for feed-related electronics and circuitry, therefore further reducing the physical profile of the overall radar system. Furthermore, various beam shaping techniques may be applied to the BAVA array to control scanning, beam width, side lobe levels and the like.

Figure 6A:
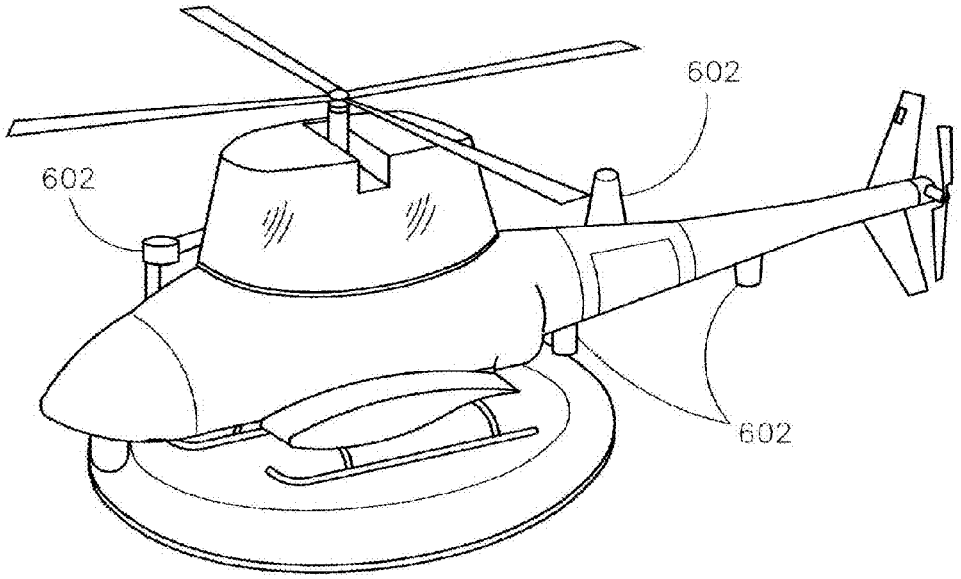
Figure 6B:
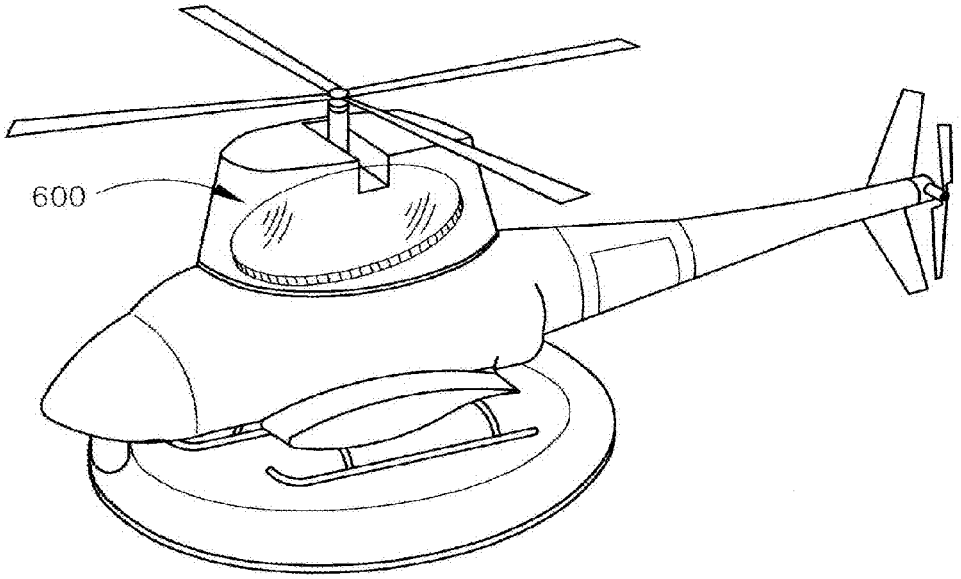

It is contemplated that the antenna/radar system in accordance with the present disclosure may be installed on a size-constrained platform and utilized as a common shared asset aperture, providing multifunctional, multi-beam support to facilitate multiband communications. For example, FIG. 6A shows an unmanned aerial vehicle (UAV) equipped with multiple narrow band antennas 602 (e.g., UHF, L, S and C band antennas) while FIG. 6B shows another UAV equipped with radar system 600 in accordance with the present disclosure. Since the radar system in accordance with the present disclosure is capable to simultaneously operate between 830 MHz to 5 GHz at multiple modes of operation (i.e., directional and omni), the narrow band antennas may be effectively replace by the radar system 600.

In addition to reducing antenna count, the radar system 600 also lowers the power consumption and its radar signature, which may be appreciated in various operating conditions. Furthermore, it is noted that the main beam in the E-plane of the array may be slightly tilted as depicted in FIG. 6B. Such a configuration may be suitable for an UAV that needs to establish a link with ground troops in the far horizon. It is also noted that the radiation pattern of the array in the H-plane may be directive with low side-lobes and deep nulls, providing a very good protection from jamming. In addition, it is understood that the particular location of the radar system 600 is merely exemplary. The radar system 600 may be mounted on the bottom of the platform as well as other suitable locations without departing from the spirit and scope of the present disclosure.

It is understood that the present invention is not limited to any underlying implementing technology. The present invention may be implemented utilizing any combination of software and hardware technology. The present invention may be implemented using a variety of technologies without departing from the scope and spirit of the invention or without sacrificing all of its material advantages.

It is understood that the specific order or hierarchy of steps in the processes disclosed is an example of exemplary approaches. Based upon design preferences, it is understood that the specific order or hierarchy of steps in the processes may be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An apparatus, comprising:

a disc-shaped conductive substrate;

a ring-shaped conductive substrate being positioned generally parallel with respect to the disc-shaped conductive substrate, the ring-shaped conductive substrate having an outer diameter generally coincides with an outer diameter of the disc-shaped conductive substrate; and a plurality of Balanced Antipodal Vivaldi Antenna (BAVA) elements each positioned perpendicularly between the disc-shaped conductive substrate and the ring-shaped conductive substrate, the plurality of BAVA elements forming a circular antenna array along edges of the disc-shaped conductive substrate and the ring-shaped conductive substrate, the plurality of BAVA elements defining an electric field plane (E-plane) of the circular antenna array, the E-plane of the circular antenna array being parallel with the disc-shaped conductive substrate and the ring-shaped conductive substrate, and the disc-shaped conductive substrate and the ring-shaped conductive substrate jointly form a parallel plate waveguide for the circular antenna array.

2. The apparatus of claim 1, wherein a distance between the disc-shaped conductive substrate and the ring-shaped conductive substrate is determined based on a lowest operating frequency supported by the apparatus.

3. The apparatus of claim 1, wherein a distance separating two adjacent BAVA elements of the plurality of BAVA elements is determined based on a highest operating frequency supported by the apparatus.

4. The apparatus of claim 1, wherein the disc-shaped conductive substrate and the ring-shaped conductive substrate jointly create two imaged BAVA elements for each of the plurality of BAVA elements, and wherein the two imaged BAVA elements created for each of the plurality of BAVA elements are created on two opposite sides of the parallel plate waveguide formed by the disc-shaped conductive substrate and the ring-shaped conductive substrate.

5. The apparatus of claim 1, wherein each of the plurality of BAVA elements is vertically polarized.

6. The apparatus of claim 1, wherein the outer diameters of the disc-shaped conductive substrate and the ring-shaped conductive substrate are approximately 2 feet, a distance between the disc-shaped conductive substrate and the ring-shaped conductive substrate is approximately 1 inch, and two adjacent BAVA elements of the plurality of BAVA elements are placed approximately 1.2 inches apart, allowing the apparatus to provide multiband coverage ranging from 830 MHz to 5 GHz.

7. An apparatus, comprising:

a first conductive substrate;

a second conductive substrate being positioned generally parallel with respect to the first conductive substrate, the second conductive substrate defining an outer perimeter that generally coincides with an outer perimeter of the first conductive substrate, and the second conductive substrate further defining an opening at a center of the second conductive substrate; and a plurality of Balanced Antipodal Vivaldi Antenna (BAVA) elements each positioned perpendicularly between the first conductive substrate and the second conductive substrate, the plurality of BAVA elements forming a continuous antenna array that loops around edges of the first conductive substrate and the second conductive substrate, the plurality of BAVA elements defining an electric field plane (E-plane) of the continuous antenna array, the E-plane of the continuous antenna array being parallel with the first conductive substrate and the second conductive substrate, and the first conductive substrate and the second conductive substrate jointly form a parallel plate waveguide for the continuous antenna array.

8. The apparatus of claim 7, wherein the plurality of BAVA elements forms at least one of: a circular antenna array, an elliptical antenna array or an oval-shaped antenna array.

9. The apparatus of claim 7, wherein a distance between the first conductive substrate and the second conductive substrate is determined based on a lowest operating frequency supported by the apparatus.

10. The apparatus of claim 9, wherein the distance is approximately 1 inch.

11. The apparatus of claim 7, wherein a distance separating two adjacent BAVA elements of the plurality of BAVA elements is determined based on a highest operating frequency supported by the apparatus.

12. The apparatus of claim 11, wherein the distance is approximately 1.2 inches.

13. The apparatus of claim 7, wherein the first conductive substrate and the second conductive substrate jointly create two imaged BAVA elements for each of the plurality of BAVA elements, and wherein the two imaged BAVA elements created for each of the plurality of BAVA elements are created on two opposite sides of the parallel plate waveguide formed by the first conductive substrate and the second conductive substrate.

14. The apparatus of claim 7, wherein the apparatus is configured for providing multiband coverage ranging from 830 MHz to 5 GHz.

15. An apparatus, comprising:

a plurality of unit cells, each unit cell further comprising:

a first conductive substrate;

a second conductive substrate being positioned generally parallel with respect to the first conductive substrate; and a Balanced Antipodal Vivaldi Antenna (BAVA) element positioned perpendicularly between the first conductive substrate and the second conductive substrate, wherein the plurality of unit cells jointly forms a continuous antenna array, the first conductive substrate and the second conductive substrate of each of the plurality of unit cells jointly form a parallel plate waveguide for the continuous antenna array, the plurality of unit cells defines an electric field plane (E-plane) of the continuous antenna array, and the E-plane of the continuous antenna array is parallel with the parallel plate waveguide for the continuous antenna array formed by the first conductive substrate and the second conductive substrate of each of the plurality of unit cells.

16. The apparatus of claim 15, wherein the plurality of unit cells jointly forms at least one of: a circular antenna array, an elliptical antenna array or an oval-shaped antenna array.

17. The apparatus of claim 15, wherein a distance between the first conductive substrate and the second conductive substrate is determined based on a lowest operating frequency supported by the apparatus.

18. The apparatus of claim 15, wherein a distance separating two adjacent BAVA elements of the continuous antenna array is determined based on a highest operating frequency supported by the apparatus.

19. The apparatus of claim 15, wherein the first conductive substrate and the second conductive substrate of each of the plurality of unit cells jointly create two imaged BAVA elements for the BAVA element of each of the plurality of unit cells, and wherein the two imaged BAVA elements created for the BAVA element of each of the plurality of unit cells are created on two opposite sides of the parallel plate waveguide formed for the continuous antenna array.

20. The apparatus of claim 15, wherein the apparatus is configured for providing multiband coverage ranging from 830 MHz to 5 GHz.

* * * * *